United States Patent [19]

DeVall et al.

[11] Patent Number: 4,478,248

[45] Date of Patent: Oct. 23, 1984

[54] ROTARY VALVE

[76] Inventors: Donald L. DeVall, 1082 Charles Ave.; Hu D. DeVall, Rte. 1, Box 362-A, both of Morgantown, W. Va. 26505

[21] Appl. No.: 459,475

[22] Filed: Jan. 20, 1983

[51] Int. Cl.[3] ..... F15B 13/042

[52] U.S. Cl. ..... 137/624.13; 91/40; 137/596.18; 137/624.18

[58] Field of Search ..... 91/39, 40; 137/596.18, 137/624.13, 624.15, 624.18, 624.2

[56] References Cited

U.S. PATENT DOCUMENTS

| | | | |
|---|---|---|---|
| 2,828,693 | 4/1958 | Davis et al. | 91/40 X |
| 3,654,961 | 4/1972 | Phillips | 137/624.13 |
| 3,810,417 | 5/1974 | Sieke | 91/39 |

FOREIGN PATENT DOCUMENTS

| | | | |
|---|---|---|---|
| 51172 | 4/1980 | Japan | 137/624.13 |

*Primary Examiner*—Gerald A. Michalsky
*Attorney, Agent, or Firm*—Webb, Burden, Robinson & Webb

[57] ABSTRACT

A rotary valve having a housing with a center section and a pair of end sections attached to the center section. A rotary shaft extending axially through the center section into said end sections with bearings in each end section rotatably supporting an end of the shaft. The center section and the end sections form a pair of axially aligned chambers within the housing and a cylindrical rotor is located in each chamber. Each rotor is fixed to the shaft for rotation with the shaft and each rotor has a continuous groove formed in its peripheral edge. A plurality of radially and angularly spaced arcuate slots are formed in each face of each rotor and a plurality of passages are formed in each rotor. The passages intersect the arcuate slots and the continuous groove to connect arcuate slots with other arcuate slots and with the groove. Passageways are formed in the end sections of the valve to connect the individual chambers with the exterior of the housing. Ports are also formed in the center section extending between one of the individual chambers and the exterior of said housing. A motor connected to an end of the shaft to rotate the shaft and the rotors to move the arcuate slots into and out of alignment with the passageways formed in the housing end sections.

12 Claims, 10 Drawing Figures

ROTARY VALVE

BACKGROUND OF THE INVENTION

1. Field of the Invention

This invention relates to a rotary valve for use in controlling the supply of hydraulic fluid to a hydraulically actuated reciprocating device such as a percussion drill or a pump and more particularly to a rotary valve for use in a hydraulic system including a reservoir and a hydraulically actuated piston wherein pressurized hydraulic fluid is supplied to opposite sides of the piston head.

2. Description of the Prior Art

Combined pumping and timing devices have been used to alternately supply hydraulic fluid to opposite sides of a piston head, but these devices are complex and cannot function continuously for any length of time due to severe maintenance problems. An example of such an arrangement may be seen in U.S. Pat. No. 3,654,961 entitled "Rotary Percussion Drill Having a Hydraulically Actuated Percussion Device," granted Apr. 11, 1972. The arrangement disclosed in the aforementioned patent may be used to provide impacting percussive forces to a drill steel by a hydraulic hammer in an apparatus for drilling bolt holes in a mine roof to accommodate roof bolts. The rotary valve of the invention described hereinafter may also be used with a hydraulically actuated percussion drill.

SUMMARY OF THE INVENTION

The invention relates to a rotary valve for use in a hydraulic system which includes a reservoir, a piston cylinder and a hydraulic motor. The rotary valve is driven by the hydraulic motor and operates to alternately provide hydraulic fluid to opposite sides of the piston head to move the piston head and the piston rod attached thereto relative to the piston cylinder. The valve consists of an outer housing which surrounds a pair of spaced valve rotors which are fixedly mounted on a rotatable shaft for rotation with the shaft relative to the housing. Each valve rotor is formed with passages and slots in communication with a continuous groove extending completely around the periphery of the rotor to permit hydraulic fluid to flow in and out of the valve housing in accordance with the different positions of the rotors in the valve housing. Because of the arrangement of the rotors and the passages, slots and grooves therein and the manner in which the pressurized hydraulic fluid flows through the valve, the amount of wear on the valve members is minimized and maintenance is greatly reduced in comparison with known devices. The pressure of the hydraulic fluid is distributed equally throughout the interior of the valve housing. Because there is equal pressure at all points in the valve housing, damage to the housing is minimal.

The principal object of the invention is to provide a rotary valve for use with fluid actuated devices such as a piston or a pump whereby the valve will alternately supply hydraulic fluid under pressure to opposite sides of a reciprocating piston head within a piston cylinder to reciprocate a piston rod attached to the piston head.

DESCRIPTION OF THE PREFERRED EMBODIMENT

Figure 1:
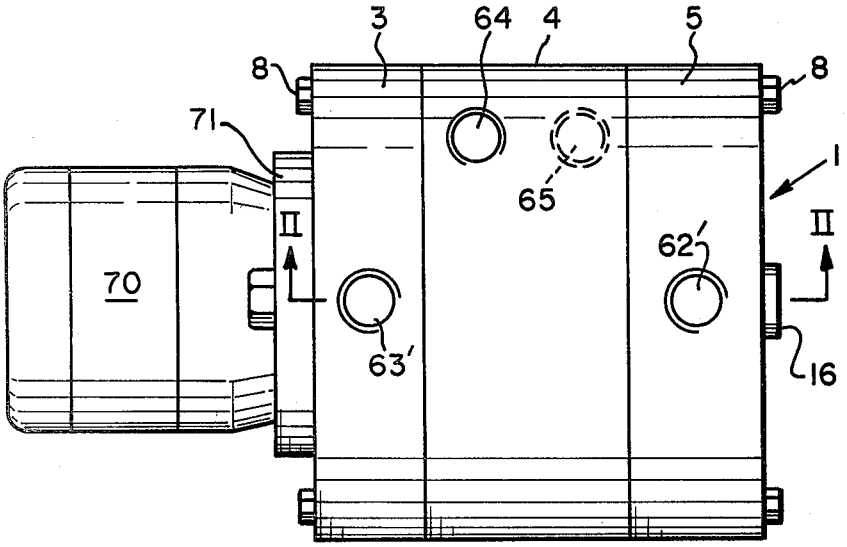
FIG. 1 is a plan view of the valve and a hydraulic motor.
Figure 2:
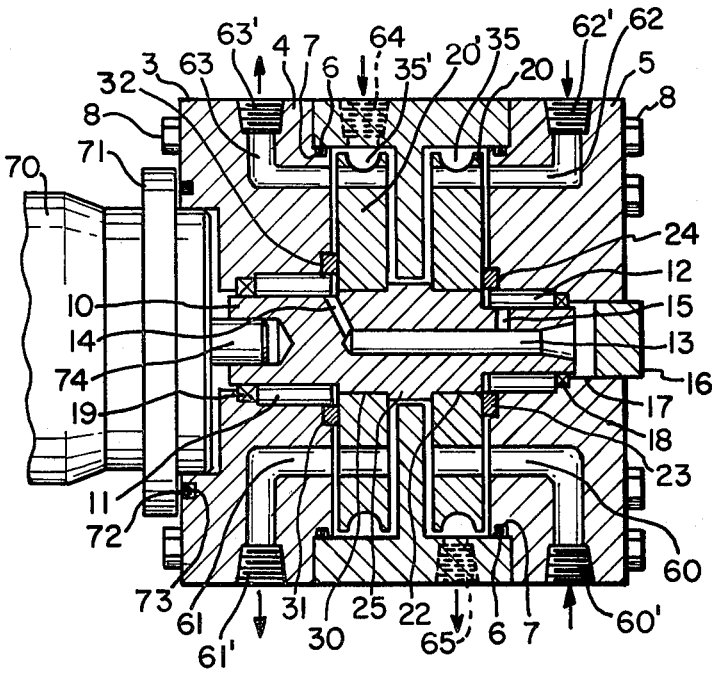
FIG. 2 is a section on line II—II of FIG. 1.
Figure 3:
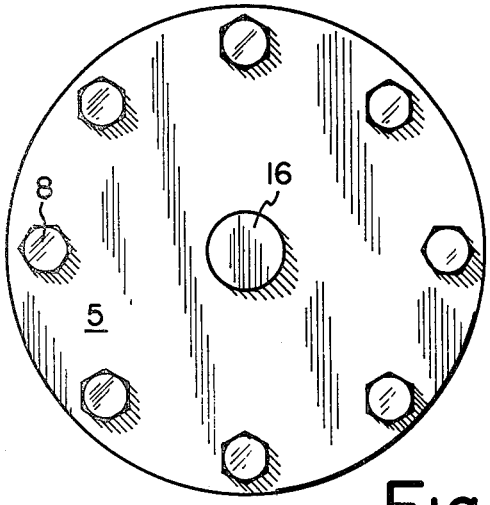
FIG. 3 is an end view of the valve shown in FIG. 1.

With reference to FIGS. 1 and 2 of the drawings, rotary valve 1 has a housing which consists of a motor end section 3, a center section 4 and a plug end section 5. The end sections are connected to the center section by a plurality of angularly spaced bolts 8. An O-ring seal 6 is located in an annular groove 7 in motor end section 3 and plug end section 4 in order to assure that no hydraulic fluid escapes from the rotary valve during use. A shaft 10 is supported in motor end section 3 by roller bearings 11 and in plug end section 5 by roller bearings 12. The shaft is formed with an axial passageway 13 throughout a portion of its length. Two radial passageways 14 and 15 extend outwardly from passageway 13 to connect passageway 13 with roller bearings 11 and 12 to provide a path for the lubricant which is supplied from the pressure side through bearing 11. A threaded plug 16 is located in a threaded opening 17 in plug end section 5 of the housing. The plug is removable for inspection purposes to make sure that shaft 10 is turning freely. An annular seal 18 is located at the outer end of roller bearings 12, and an annular seal 19 is located at the outer end of roller bearings 11. The seals assure that the lubricant is maintained in contact with the roller bearings.

A pair of cylindrical rotors 20 and 20′ having the same diameter and thickness are supported on shaft 10 as shown in FIG. 2 of the drawings. Rotor 20 is shown in detail in FIGS. 4–7 of the drawings. Rotor 20 is formed with a central opening 22 which embraces shaft 10. One face of rotor 20 adjacent central opening 22 abuts a shoulder 25 formed on the exterior of shaft 10. The opposite face of rotor 20 adjacent central opening 22 is in contact with a thrust bearing 23 located in an annular notch 24 formed in plug end section 5. Rotor 20 is nonrotatably held on shaft 10 by an elongated key (not shown) which fits into an axially extending keyway (not shown) on shaft 10 and a keyway 27 formed in the rotor.

Rotor 20′ is formed with a central opening 30 which embraces shaft 10. One face of rotor 20′ adjacent central opening 30 abuts the shoulder 25 on shaft 10. The opposite face of rotor 20′ adjacent central opening 30 is in contact with a thrust bearing 31 located in an annular notch 32 formed in motor end section 3. Rotor 20′ is nonrotatably held on shaft 10 by an elongated key (not shown) which is located in axial keyways (not shown) in the shaft and the rotor. Rotors 20 and 20′ are identical, and the following description of rotor 20 also applies to rotor 20′. The same reference numbers are used with a prime to identify like elements on rotor 20′.

Rotor 20 is formed with a continuous groove 35 throughout its periphery. The base of groove 35 is in communication with one end of four inwardly directed passages 36, 37, 38 and 39 which are slightly offset from a radius of the rotor. The inner ends of passages 36 and 37 are in communication with opposite ends of a short arcuate slot 40 formed in face 41 of rotor 20 and with a short arcuate slot 42 formed in the opposite face 43 of rotor 20. Slots 40 and 42 are in corresponding positions on opposite faces of the rotor. The outer end of passage 36 which is in communication with the base of continuous groove 35 is also in communication with one end of a long arcuate slot 44 which is formed in face 41 and which is radially spaced outwardly from short slot 40. The outer end of passage 36 is also in communication with one end of a long arcuate slot 45 formed in face 43 of rotor 20 and spaced radially outwardly from short slot 42. The position of slot 44 in face 41 corresponds with the position of slot 45 in face 43. Because of the diameter of the passages and the depth of the slots relative to the thickness of the rotor, a hole is formed completely through the rotor where the end of a passage intersects the ends of opposing slots. The hole formed at the intersection of passage 36 with slots 40 and 42 is designated 50, and the hole formed at the intersection of passage 36 with slots 44 and 45 is designated 51.

The outer end of passage 37 which is in communication with the base of continuous groove 35 is also in communication with one end of a long arcuate slot 46 which is formed in face 41 of rotor 20 and which is radially spaced outwardly from the center of the rotor the same distance as slot 44. The outer end of passage 37 is also in communication with one end of a long arcuate slot 47 which is formed in face 43 of rotor 20 and is radially spaced outwardly from slot 42. The position of slot 47 in face 43 corresponds with the position of slot 46 in face 41. The hole formed at the intersection of passage 37 with slots 40 and 42 is designated 52, and the hole formed at the intersection of passage 37 with slots 46 and 47 is designated 53.

The inner ends of passages 38 and 39 are in communication with opposite ends of a short arcuate slot 48 formed in face 41 of rotor 20 and with a corresponding short arcuate slot 49 formed in face 43 of rotor 20. The outer end of passage 38 which is in communication with the base of continuous groove 35 is also in communication with the end of long arcuate slot 44 opposite the end of slot 44 which is in communication with passage 36. The outer end of passage 38 is also in communication with the end of long arcuate slot 45 opposite the end of slot 45 which is in communication with passage 36. The hole formed at the intersection of passage 38 with slots 48 and 49 is designated 54, and the hole formed at the intersection of passage 38 with slots 44 and 45 is designated 55.

The outer end of passage 39 which is in communication with the base of continuous groove 35 is also in communication with the end of long arcuate slot 46 opposite the end of slot 46 which is in communication with passage 37. The outer end of passage 39 is also in communication with the end of long arcuate slot 47 opposite the end of slot 47 which is in communication with passage 39. The hole formed at the intersection of passage 39 with slots 46 and 47 is designated 56, and the hole formed at the intersection of passage 39 with slots 48 and 49 as designated 57.

Figure 5:
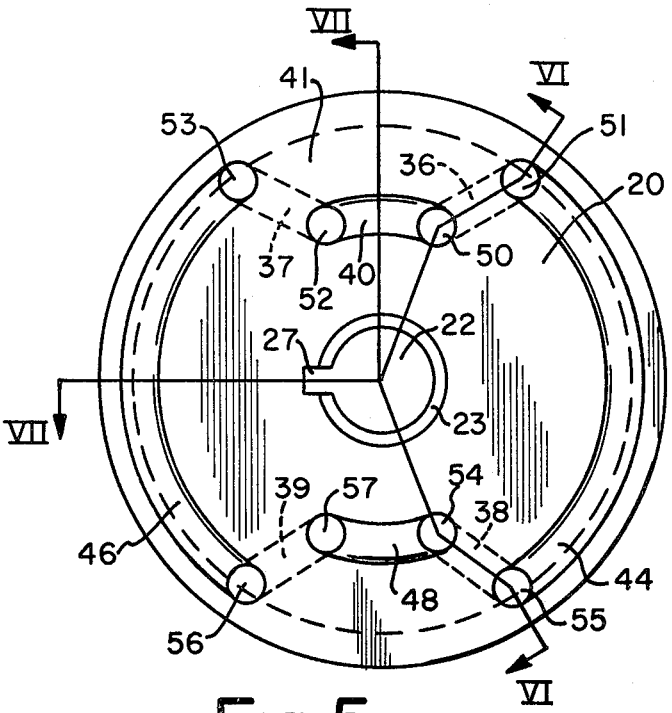
FIG. 5 is a plan view of the rotor shown in FIG. 4.
Figure 6:
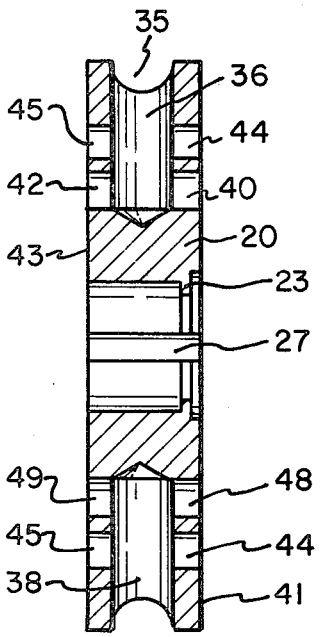
FIG. 6 is a section on line VI—VI of FIG. 5.
Figure 7:
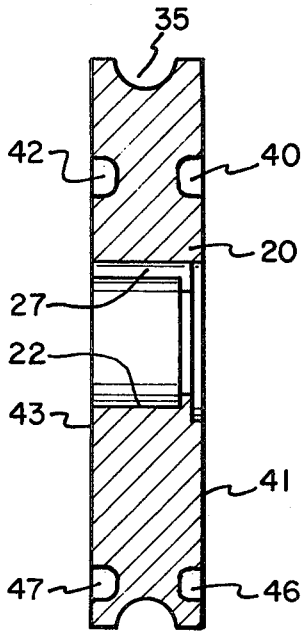
FIG. 7 is a section on line VII—VII of FIG. 5.

As can be seen in FIG. 5 of the drawings, the short arcuate slots 40 and 48 in face 41 of rotor 20 extend over approximately 75° of a circle including short arcuate slots 40 and 48. The long arcuate slots 44 and 46 in face 41 of rotor 20 extend over approximately 215° of a circle including long arcuate slots 44 and 46. The short arcuate slots 42 and 49 and long arcuate slots 45 and 47 in face 43 of rotor 20 extend over the same portions of circles as the short and long arcuate slots in face 41.

The slots and passages in the rotor permit hydraulic fluid to flow between continuous groove 35 in the edge of the rotor and passageways in the end sections 3 and 5 of rotary valve 1. As can be seen in FIG. 2 of the drawings, the end sections are formed with passageways 60, 61, 62 and 63. Each passageway has two legs which are at a right angle. The axially extending legs of the passageways are radially spaced from the center line of the valve so that the ends of passageways 60 and 61 are at the same radial distance from the center line of the valve as short arcuate slots 40, 42, 48 and 49. The axial legs of passageways 62 and 63 in the end sections are spaced the same radial distance from the center line of the valve as long arcuate slots 44, 45, 46 and 47. Each passageway is formed with a threaded port at the end which opens out of the rotary valve. Thus, passageway 60 has a threaded port 60', passageway 61 has a threaded port 61', passageway 62 has a threaded port 62' and passageway 63 has a threaded port 63'. The center section of the valve is provided with a threaded inlet port 64 and threaded outlet port 65 which are angularly spaced by approximately 90°. The ports provide communication between the rotary valve and the rest of the hydraulic system with the flow of hydraulic fluid being in the directions shown by the arrows in FIGS. 2 and 8 of the drawings. Rotary valve 1 is connected into the hydraulic system by standard couplings which are screwed into threaded ports 60', 61', 62', 63', 64 and 65.

A standard hydraulic motor 70 is bolted to motor end section 3 by bolts which extend through annular end member 72 of the motor into motor end section 3. The hydraulic motor is well known to those skilled in the art and forms no part of the invention. An O-ring seal 72 is located in an annular groove 73 formed in the end of the motor end section and is located between the end of the motor end section and end member 71 on hydraulic motor 70. A drive shaft 74 for rotating shaft 10 in the rotary valve extends from hydraulic motor 70 into an elongated cavity formed in the end of shaft 10. The shafts 10 and 74 are connected by a standard key (not shown) which is located in elongated axial keyways (not shown) in the shaft and the surface of the cavity so that rotation of hydraulic motor 70 rotates shaft 74 which drives shaft 10 and the rotors carried thereon to control the passage of hydraulic fluid through the valve.

Figure 9:
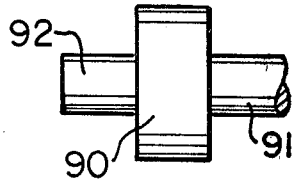
FIG. 9 is an elevation of a piston head with a rod attached thereto.
Figure 10:
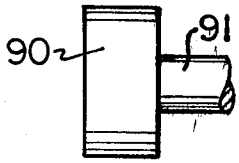
FIG. 10 is a modification of the piston head shown in FIG. 9.
Figure 4:
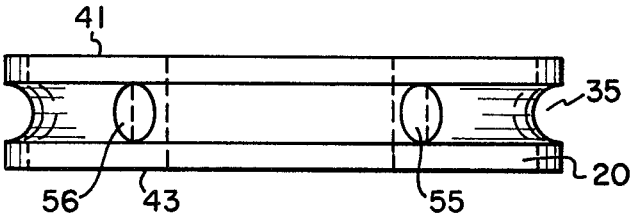
FIG. 4 is an elevation of a valve rotor.
Figure 8:
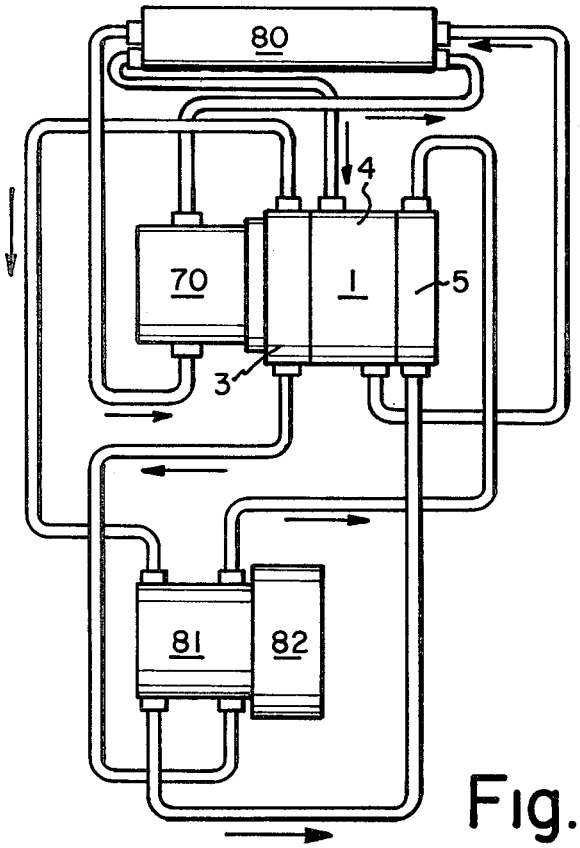
FIG. 8 is a hydraulic system including the rotary valve of the invention.

The hydraulic system shown in FIG. 8 includes rotary valve 1 of the present invention along with hydraulic motor 70 to drive the rotary valve. The system also includes a reservoir 80 for hydraulic fluid and a piston cylinder 81 which contains a piston head 90 and piston rod 91 such as shown in FIGS. 9 and 10. The piston head is driven by hydraulic fluid passing through the rotary valve and the various conduits which form part of the hydraulic system. The flow of hydraulic fluid in the system is controlled by the rotary valve to drive piston head 90 and thereby reciprocate piston rod 91 in cylinder 81 in a well known manner. The piston head and attached piston rod move in cylinder 81 and thereby move the drill 82 or other device connected to the free end of the piston rod. The direction of flow of the hydraulic fluid in the system is shown by the arrows in FIGS. 2 and 8 of the drawings.

The operation of the rotary valve will be understood from a consideration of FIGS. 2 and 8–10 of the drawings. In the first cycle of the valve when piston rod 91 is in the retracted position in piston cylinder 81, hydraulic fluid under pressure is supplied to the rotary valve through threaded inlet port 64 in valve center section 4 from reservoir 80. The hydraulic fluid flows through the groove, the passages and the slots in rotor 20' and exits the valve through passageway 63 and threaded port 63' in motor end section 3 of the valve to act on piston head 90 in piston cylinder 81 and extend piston rod 91 out of piston cylinder 81. When the piston head is moved in piston cylinder 81 to extend the piston rod, hydraulic fluid is forced out of piston cylinder 81 on the retract side of the piston head and flows through a conduit to threaded port 62' in plug end section 5 of the rotary valve. The hydraulic fluid flows from threaded port 62' through the groove, the passages and the slots in rotor 20 to threaded outlet port 65 in center section 4 of the valve from where it flows back to reservoir 80.

In the second cycle of the rotary valve when piston rod 91 is extended from piston cylinder 81, hydraulic fluid under pressure is supplied to the rotary valve from reservoir 80 through threaded inlet port 64 in valve center section 4. The hydraulic fluid flows through the groove, the passages and the slots in rotor 20' to passageway 61 and leaves the rotary valve through threaded port 61' in motor end section 3 of the rotary valve to act on the piston head in piston cylinder 81 and retract the piston head and the piston rod into piston cylinder 81. When the piston head is moved in piston cylinder 81 to retract the piston rod, hydraulic fluid is forced out of piston cylinder 81 on the extend side of the piston and flows through a conduit to threaded port 60' in plug end section 5 of the rotary valve. The hydraulic fluid flows through passageway 60 to rotor 20 from threaded port 60'. The hydraulic fluid then flows through the groove, the passages and the slots in rotor 20 to threaded outlet port 65 in center section 4 of the rotary valve from where it flows through a conduit back to reservoir 80.

As shown in FIG. 9, the piston head may be constructed so that the area on the extend side which is contacted by the hydraulic fluid is equal to the area on the retract side which is contacted by the hydraulic fluid. Such is accomplished by providing the extend side of piston head 90 with a stub 92 having the same diameter as piston rod 91. In the arrangement shown in FIG. 10, the area of the extend side of the piston head is greater than the area of the retract side because piston rod 91 is attached to the retract side. The slots in the valve rotors 20 and 20' are sized in a ratio according to the ratio of the areas on the opposite sides of the piston head. For example, when the area on each side of the piston head is the same as shown in FIG. 9, the outer slots in both rotors are the same and each slot extends through a 90° arc. When the piston head is constructed in the manner shown in FIG. 10, the ratio of the size of the slots in the rotors will be 3 to 1 if the area on the extend side of the piston head is three times greater than the area on the retract side of the piston head.

As will be apparent to one skilled in the art, the rotational position of rotors 20 and 20' relative to end sections 3 and 5 and center section 4 of the rotary valve determine the direction of flow of the hydraulic fluid through the valve.

While a preferred embodiment of the invention is described herein, it is to be understood that the invention may be embodied within the scope of the appended claims.

We claim:

1. A rotary valve including a housing, said housing having a center section and an end section attached to each end of said center section, seal means located between the ends of said center section and said end sections, a shaft extending axially through said center section into said end sections, bearing means in each of said end sections rotatably supporting an end of said shaft, said center section and said end sections cooperating with said shaft to define a pair of individual chambers within said housing, a cylindrical rotor having opposed substantially parallel faced located in each individual chamber, said rotors being fixed to said shaft for rotation with said shaft relative to said housing, a continuous groove formed in the periphery of each of said rotors, a plurality of radially and angularly spaced arcuate slots formed in each face of each of said rotors, a plurality of passages formed in each of said rotors, said passages intersecting said arcuate slots and said continuous groove to connect arcuate slots with other arcuate slots and with said continuous groove, passageways formed in said end sections, said passageways having a first end opening into one of said individual chambers and selectively aligned with arcuate slots in said rotors when said rotors rotate with said shaft and a second end opening out of said housing, a plurality of ports formed in said center section of said housing extending between one of said individual chambers and the exterior of said housing, and drive means connected to an end of said shaft to rotate said shaft and said rotors to move said arcuate slots into and out of alignment with the first ends of said passageways formed in said housing end sections.

2. A rotary valve as set forth in claim 1 wherein said drive means is a hydraulic motor having a drive shaft connected to said shaft in the valve.

3. A rotary valve as set forth in claim 1 wherein said shaft includes passageway means forming a path connecting said bearings in said end sections whereby lubricant is provided to said bearing means.

4. A rotary valve as set forth in claim 1 wherein said bearings are roller bearings.

5. A rotary valve as set forth in claim 1 wherein said passageways in said housing end sections have a right angle shape with an axial leg and a radial leg, the axial leg of said passageways being radially spaced from the center line of said shaft a distance equal to the radial spacing of arcuate slots from the center line of said shaft, whereby said first ends of said passageways are on said axial legs of said passageways and are aligned with said arcuate slots to permit passage of fluid between said arcuate slots and said passageways.

6. A rotary valve as set forth in claim 1 or 5 wherein said arcuate slots in opposite faces of said rotors are complimentary and wherein some of said plurality of arcuate slots are spaced a greater radial distance from the center line of said shaft than other arcuate slots.

7. A rotary valve as set forth in claim 6 wherein the depth of said arcuate slots and said continuous groove and the diameter of said passages are such that the intersection of each of said passages with said arcuate slots and said continuous groove forms an axial hole extending completely through said rotor from one face to the other face.

8. a rotary valve as set forth in claim 1 wherein said plurality of arcuate slots in each face of the rotors includes two short arcuate slots spaced from the center line of said shaft and two long arcuate slots located between a circle including said short arcuate slots and the external diameter of said rotors.

9. A rotary valve as set forth in claim 8 wherein said short arcuate slots extend over approximately 75° of a circle including said short arcuate slots, and said long arcuate slots extend over approximately 215° of a circle including said long arcuate slots.

10. A rotary valve as set forth in claim 9 wherein each of said passages intersects an end of a short arcuate slot and an end of a long arcuate slot and intersects the base of said continuous groove adjacent to an end of a long arcuate slot.

11. A rotary valve as set forth in claim 1 wherein the second end of each of said passageways and said plurality of ports in said housing center section are threaded to receive couplings for connecting said rotary valve into a hydraulic system.

12. A rotary valve as set forth in claim 1 wherein said center section includes an axially extending annular wall portion between said end sections and an inwardly extending radial wall portion spaced from said end sections to define said pair of individual chambers with said end sections, an axial opening through said radial wall portion, said shaft passing through said axial opening, an annular notch formed in each of said end sections adjacent to said shaft and a thrust bearing located in each of said annular notches, whereby each of said thrust bearings contacts a face of a rotor.

* * * * *